United States Patent [19]

Selcukoglu et al.

[11] 4,187,689

[45] Feb. 12, 1980

[54] APPARATUS FOR RELIQUEFYING BOIL-OFF NATURAL GAS FROM A STORAGE TANK

[75] Inventors: Yuksel A. Selcukoglu, Naperville; Matloob Husain, Wheaton; Carl C. Hanke, Jr., Oak Brook, all of Ill.

[73] Assignee: Chicago Bridge & Iron Company, Oak Brook, Ill.

[21] Appl. No.: 941,785

[22] Filed: Sep. 13, 1978

[51] Int. Cl.[2] ..... F17C 7/02

[52] U.S. Cl. ..... 62/54; 62/12; 62/47; 220/85 VR

[58] Field of Search ..... 62/10, 12, 13, 35, 46, 62/47, 48, 54; 220/85 VR, 85 VS

[56] References Cited

U.S. PATENT DOCUMENTS

| | | | |
|---|---|---|---|
| 3,303,660 | 2/1967 | Berg | 62/54 |
| 3,798,918 | 3/1974 | Maher et al. | 62/54 |
| 4,001,116 | 1/1977 | Selcukoglu | 62/13 |

*Primary Examiner*—Ronald C. Capossela

*Attorney, Agent, or Firm*—Merriam, Marshall & Bicknell

[57] ABSTRACT

In a combination of apparatus for storing liquefied natural gas which includes an insulated separation tank in which solidified carbon dioxide is settled out of liquefied natural gas and a liquefied natural gas-solidified carbon dioxide slurry accumulates, an insulated liquefied natural gas storage tank, and a conduit for delivering liquefied natural gas from the separation tank to the storage tank, the improvement comprising a conduit for withdrawing natural gas boil-off from the storage tank and feeding it to a compressor, a conduit for feeding compressed natural gas boil-off from the compressor to a heat exchanger for indirect heat exchange with a liquefied natural gas-solidified carbon dioxide slurry in the separation tank to cool the compressed natural gas to reliquefied natural gas, and a conduit to feed the reliquefied natural gas from the heat exchanger to the storage tank.

5 Claims, 1 Drawing Figure

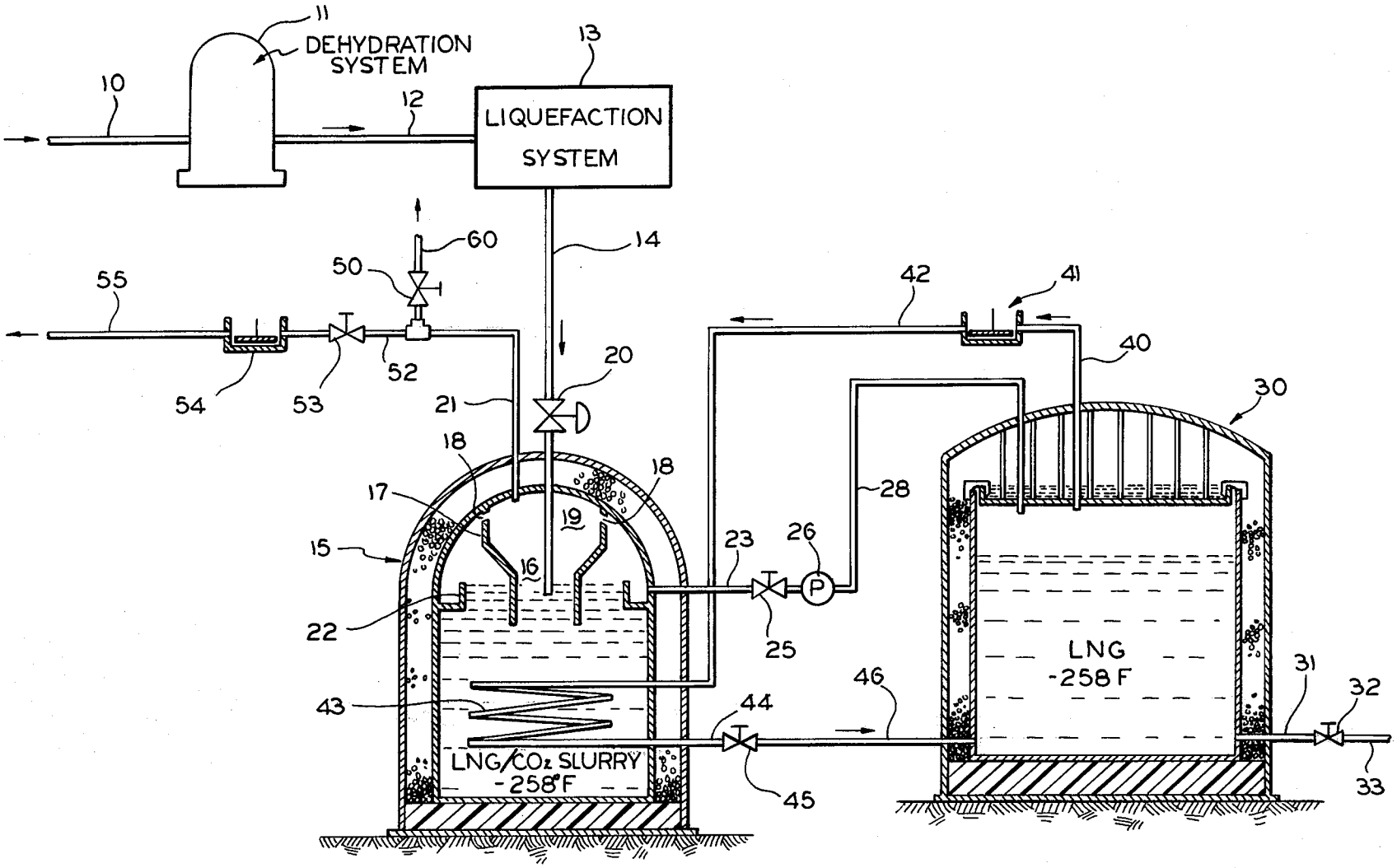
LIQUEFACTION SYSTEM
DEHYDRATION SYSTEM
LNG -258 F
LNG/CO2 SLURRY -258°F
P

APPARATUS FOR RELIQUEFYING BOIL-OFF NATURAL GAS FROM A STORAGE TANK

This invention relates to apparatus and processes for storing liquefied natural gas. More particularly, this invention provides apparatus and methods for inexpensively reliquefying boil-off natural gas from a storage tank and conserving energy.

Liquefied natural gas is presently stored in large insulated tanks at about −258° F. at slightly above atmospheric pressure. Insulated double-walled metal tanks are generally used to store the liquefied natural gas. See, for example, U.S. Pat. Nos. 3,147,878; 3,352,443; and 3,798,918. The liquefied natural gas is somtimes held as a reserve as, for example, for use during exceptionally cold winter seasons when the demand for natural gas for industrial and heating purposes is exceedingly high.

The natural gas as obtained from wells normally contains varying amounts of water, carbon dioxide, and other gases such as hyrogen sulfide. It is generally necessary to remove the water as well as impurities such as hydrogen sulfide before the natural gas is liquefied. Some processes also remove the carbon dioxide gas before liquefying the natural gas. Such procedures usually require the use of molecular sieves or special solvents. A more economical method is to pressurize and cool the carbon dioxide-containing natural gas and to then expand it so that simultaneously there is obtained liquefied natural gas containing solidified carbon dioxide. The resulting mixed stream can then be fed to a separating tank in which the solidified carbon dioxide settles and from which liquefied natural gas free of solidified carbon dioxide is removed for delivery by a suitable conduit to a liquefied natural gas storage tank. Apparatus for such a carbon dioxide removal system is disclosed in Selcukoglu U.S. Pat. No. 4,001,116. As the amount of natural gas liquefied increases there is obtained a rather close-packed slurry of solidified carbon dioxide in liquefied natural gas in the separation tank. Once the storage tank is full of liquefied natural gas, the holding period begins. However, heat leak into the storage tank results in the continuous boil-off of natural gas which must be reliquefied or delivered to a pipeline.

SUMMARY OF THE INVENTION

According to the present invention there is provided an improvement in apparatus for storing liquefied natural gas which includes an insulated separation tank in which solidified carbon dioxide is settled out of liquefied natural gas and a liquefied natural gas-solidified carbon dioxide slurry accumulates, an insulated liquefied natural gas storage tank, and a conduit for delivering liquefied natural gas from the separation tank to the storage tank, with the improvement including a means for withdrawing boil-off natural gas from the storage tank and compressing it, a conduit means for feeding the compressed boil-off natural gas into indirect heat exchange with a liquefied natural gas-solidified carbon dioxide slurry in the separation tank to cool the compressed natural gas to reliquefied natural gas, and a means to feed the reliquefied natural gas from the separation tank to the storage tank. The described improvement thus utilizes the inherent refrigeration present in the liquefied natural gas-carbon dioxide slurry in the separation tank. In this way, enough refrigeration can be obtained to permit reliquefaction of natural gas boil-off from the storage tank during a substantial part of the holding period.

The conduit means for feeding the compessed boil-off natural gas into indirect heat exchange with the slurry desirably includes a heat exchanger coil in the separation tank. The compressed natural gas boil-off flows through the coil and by means of heat exchange with the slurry is cooled to a temperature which at the pressure of the gas leads to its liquefaction. The resulting liquefied natural gas is then conveyed from the coil through a conduit to the storage tank.

The improvement according to the invention also desirably includes a vapor space in the separation tank, a conduit communicating with the vapor space and with a compressor, and a conduit extending from the compressor to a distribution pipeline to thereby dispose of vapor from the separation tank, which is rich in natural gas and low in carbon dioxide gas during the initial phase of the operation.

The improvement also includes a conduit from the separation tank vapor space to a flare or vent stack for disposing of carbon dioxide-rich vapor from the separation tank during the latter phase of the operation.

The slurry in the separation tank and the liquefied natural gas in the storage tank are generally both at about −258° F. and slightly above atmospheric pressure.

The flow of compressed boil-off gas from the storage tank into indirect heat exchange with the slurry in the separation tank results in heat gain by the slurry, leading to vaporization of the separation tank contents. The vapor formed is initially very rich in natural gas, and thus can be returned to a pipeline for commercial use. However, with increased vaporization of the separation tank contents, the gaseous carbon dioxide content of the vapor increases so that ultimately the gas formed may no longer desirably be returned to a pipeline and it, therefore, may be directed to a flare or vent stack for disposition.

THE DRAWING

The drawing is a schematic illustration of the improved apparatus provided by the invention.

DETAILED DESCRIPTION OF THE DRAWING

As shown in the drawing, a feed stream of natural gas containing water and carbon dioxide as impurities is delivered by conduit 10 to a dehydration system 11 for removing the water content. The water-free natural gas is then delivered by conduit 12 from the dehydration system 11 to a liquefaction system 13 where the natural gas containing carbon dioxide is compressed and cooled to conditions which are suitable for its liquefaction. The liquefied natural gas containing solidified carbon dioxide is fed from the liquefaction system 13 by conduit 14 through expansion valve 20 to separation tank 15. Separation tank 15 is a double-walled tank with insulation between the walls to retard heat leak. The liquefied natural gas is supplied to a stilling chamber space 16 which is defined by a walled member 17 in the separation tank 15. Holes 18 are provided in the walled member 17 to equalize pressure and allow free flow of vapor into the vapor space 19 from which it can be removed by conduit 21.

The solidified carbon dioxide settles in the separation tank 15, and forms a closely packed slurry with liquefied natural gas. As the level of liquefied natural gas rises in separation tank 15, it reaches the top of weir 22 and flows over it into the trough thereby defined so that it can be removed by conduit 23. The liquefied natural gas flows through conduit 23 and through open valve 25 to pump 26 which forces it through conduit 28 into storage tank 30.

Storage tank 30 is a conventional suspended-roof double-walled insulated storage tank of the type disclosed in Sattleberg et al. U.S. Pat. No. 3,352,443. The structure of the storage tank will therefore not be described further. Liquefied natural gas is removed from the storage tank 30 by means of conduit 31, valve 32 and conduit 33. Conduit 33 can be connected to any suitable delivery line to feed the liquefied natural gas to a vaporization system and then to a suitable destination.

During the holding period for the liquefied natural gas in storage tank 30, there is heat leak into the tank and a continuous formation of natural gas boil-off. This natural gas boil-off is removed from the vapor space of storage tank 30 by conduit 40 which delivers the natural gas to compressor 41, where it is increased from about slightly above atmospheric pressure to a suitable pressure at which it is totally or partially condensed. The compressed natural gas is then fed from compressor 41 through conduit 42 into heat exchanger coil 43 located in the lower part of separation tank 15. As the natural gas flows through coil 43, it is cooled to a liquefaction temperature. The liquefied natural gas is then removed from coil 43 by conduit 44 and passed through valve 45 to conduit 46 which delivers the reliquefied natural gas to storage tank 30.

The heat from the compressed natural gas fed through coil 43 results in vaporization of the liquefied natural gas-solidified carbon dioxide slurry in separation tank 15. The vapor so formed accumulates in vapor space 19 and is removed through conduit 21. With valve 50 closed, the natural gas rich vapor is fed from conduit 21 to conduit 52, through open valve 53 to compressor 54. The natural gas under increased pressure is then delivered from compressor 54 to conduit 55, which delivers it to a distribution pipeline or other suitable destination.

As the vaporization of the slurry in separation tank 15 proceeds, the carbon dioxide gas content of the vapor rises to a concentration at which it may no longer be suitable to return it to a pipeline or to use it as a fuel, as dictated by the burning characteristics and heating value of the mixed gas. Under such circumstances, valve 53 is closed and valve 50 is opened so that the vapor can be fed through conduit 60 to a suitable local flare or vent stack.

The foregoing detailed description has been given for clearness of understanding only, and no unnecessary limitations should be understood therefrom, as modifications will be obvious to those skilled in the art.

What is claimed is:

1. In a combination of apparatus for storing liquefied natural gas which includes an insulated separation tank in which solidified carbon dioxide is settled out of liquefied natural gas and a liquefied natural gas-solidified carbon dioxide slurry accumulates, an insulated liquefied natural gas storage tank, and a conduit for delivering liquefied natural gas from the separation tank to the storage tank, the improvement comprising:

means for withdrawing natural gas boil-off from the storage tank and compressing it, conduit means for feeding the compressed natural gas boil-off into indirect heat exchange with a liquefied natural gas-solidified carbon dioxide slurry in the separation tank to cool the compressed natural gas to reliquefied natural gas, and means to feed the reliquefied natural gas from the separation tank to the storage tank.

2. The improvement according to claim 1 in which the conduit means for feeding the compressed natural gas boil-off into indirect heat exchange with the slurry includes a coil in the separation tank.

3. The improvement according to claim 1 in which the separation tank has a vapor space, a conduit communicating with the vapor space and a compressor and a conduit extending from the compressor to a distribution pipeline to thereby dispose of vapor, from the separation tank, rich in natural gas and low in carbon dioxide gas.

4. The improvement according to claim 1 in which both the storage tank and separation tank contents are at about −258° F. and at slightly above atmospheric pressure.

5. The improvement according to claim 3 in which the separation tank has a vapor space, and a conduit communicating with the vapor space and a flare or vent stack for disposing of carbon dioxide-rich vapor from the separation tank.

* * * * *